US009303846B2

(12) United States Patent
Chinniah et al.

(10) Patent No.: US 9,303,846 B2
(45) Date of Patent: Apr. 5, 2016

(54) DIRECTIONAL LAMP WITH ADJUSTABLE BEAM SPREAD

(71) Applicant: GE LIGHTING SOLUTIONS, LLC, East Cleveland, OH (US)

(72) Inventors: Jeyachandrabose Chinniah, Willoughby Hills, OH (US); Benjamin Lee Yoder, Cleveland Heights, OH (US); Thomas Clynne, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 46 days.

(21) Appl. No.: 13/906,387

(22) Filed: May 31, 2013

(65) Prior Publication Data

US 2014/0355264 A1 Dec. 4, 2014

(51) Int. Cl.
*F21V 14/06* (2006.01)
*F21V 13/04* (2006.01)
(Continued)

(52) U.S. Cl.
CPC . *F21V 14/06* (2013.01); *F21K 9/58* (2013.01); *F21V 5/007* (2013.01); *F21V 5/008* (2013.01); *F21V 13/04* (2013.01); *F21Y 2101/02* (2013.01)

(58) Field of Classification Search
CPC ..... F21V 13/04; F21V 14/06; F21V 5/007; F21V 5/04; F21V 7/0091; F21V 13/02; F21V 5/008; F21V 9/137; F21V 9/58; F21V 5/005; F21V 5/006; F21V 7/0066; F21V 14/065; F21V 14/08; F21V 19/001; F21V 19/02; F21S 2/005; F21W 2131/406; G02B 27/0961; G02B 7/021; G02B 7/10; G02B 19/0061; F21K 9/137; F21K 9/58; F21Y 2101/02; F21Y 2113/005; F21Y 2105/001
USPC ..... 362/174, 187, 188, 197, 217.01, 362/217.04, 217.12, 217.16, 232, 249.01, 362/249.02, 277, 279, 282, 310, 319, 362/326–329, 336, 512, 522
See application file for complete search history.

(56) References Cited

U.S. PATENT DOCUMENTS 6,000,813 A 12/1999 Krietzman
6,048,080 A * 4/2000 Belliveau ..... 362/282
(Continued)

FOREIGN PATENT DOCUMENTS

DE 102009060566 A1 6/2011
EP 1459600 7/2003
(Continued)

OTHER PUBLICATIONS

PCT Search Report issued in connection with corresponding WO Patent Application No. PCT/US2014/034776 dated on Sep. 4, 2014.

*Primary Examiner* — Hargobind S Sawhney
(74) *Attorney, Agent, or Firm* — GE Global Patent Operation; Peter T. DiMauro

(57) ABSTRACT

A lamp having a lamp base and a longitudinal axis, with a first lens with more than one segment having optic elements located distal from the lamp base. Where optic elements within a segment have similar optical properties and at least two of the segments have optic elements with different optical properties. A second lens located between the distal lens and the lamp base, the second lens having a plurality of total internal reflection (TIR) lens elements each having a focal point, with a finite light source is positioned at about each of the TIR lens element focal points. At least one of the first lens or the second lens is moveable about the longitudinal axis so as to change an alignment between the optic element segments, the TIR lens elements, and the finite light sources.

7 Claims, 7 Drawing Sheets

(51) Int. Cl.

| | |
|---|---|
| ***F21K 99/00*** | (2010.01) |
| ***F21V 5/00*** | (2015.01) |
| *F21Y 101/02* | (2006.01) |

(56) References Cited

U.S. PATENT DOCUMENTS

| | | | | |
|---|---|---|---|---|
| 6,183,129 | B1 | 2/2001 | Aoyama et al. | |
| 7,901,086 | B2 | 3/2011 | Ripoll et al. | |
| 7,950,821 | B1 * | 5/2011 | Georgitsis et al. | 362/217.12 |
| 7,982,936 | B2 | 7/2011 | Broome et al. | |
| 8,000,022 | B2 | 8/2011 | Niederer | |
| 8,147,089 | B2 * | 4/2012 | Matthews et al. | 362/199 |
| 8,246,210 | B2 * | 8/2012 | Angelini et al. | 362/279 |
| 2003/0053310 | A1 | 3/2003 | Sommers | |
| 2003/0137844 | A1 | 7/2003 | Bucher et al. | |
| 2008/0273324 | A1 | 11/2008 | Becker et al. | |
| 2010/0165623 | A1 * | 7/2010 | Bremerich et al. | 362/235 |
| 2010/0232159 | A1 | 9/2010 | Lai | |
| 2011/0222301 | A1 | 9/2011 | Knoedgen et al. | |

FOREIGN PATENT DOCUMENTS

| | | | |
|---|---|---|---|
| EP | 1620676 | | 11/2004 |
| EP | 1754121 | | 9/2005 |
| EP | 2239600 | A1 | 10/2010 |
| EP | 2314912 | A1 | 4/2011 |
| EP | 2503231 | A2 | 9/2012 |
| WO | 03055273 | | 7/2003 |
| WO | 2004100624 | | 11/2004 |
| WO | 2005089293 | | 9/2005 |
| WO | WO 2007007271 | A2 * | 1/2007 |
| WO | 2013060329 | A1 | 5/2013 |

* cited by examiner

DIRECTIONAL LAMP WITH ADJUSTABLE BEAM SPREAD

BACKGROUND

Directional lamp types, including PAR, R, BR, and MR, are available with different beam spread specifications. A typical lamp of this type only provides a fixed beam spread that is not selectable by the end user. In order to have a different beam spread, a different lamp with a different spread specification is needed.

The beam spread desired for a particular lighting task can be used to determine the lamp selection. For example, a spotlight produces a narrow beam of intense light that can be used for display lighting, a floodlight produces a broader beam suitable for general lighting tasks, and a wallwasher produces an even broader beam that can light entire wall surfaces in architectural spaces.

Mechanically actuated, variable optics can provide adjustment of the beam spread emitted from a fixture by changing the shape of optical surfaces (e.g., reflecting and/or refracting surfaces) and deforming the lens surface. Such mechanical actuation can change the beam spread emitted from a fixture without changing the lamp installed in the fixture.

DETAILED DESCRIPTION

A lamp in accordance with embodiments can produce multiple selectable beam spreads from the one lamp by including a combination of two lenses within the lamp. The lamp can include a lens located distal from the lamp base, the distal lens including segments with optic elements that differ between the segments, and an intermediate lens located between the lamp base and the distal lens. The intermediate lens can include total internal reflection (TIR) lens elements. Each of the TIR lenses can correspond in position to finite light sources (e.g., LED light sources) located between the lamp base and the intermediate lens surface proximal to the lamp base. Positioning of the distal lens segments with respect to the TIR lens on the intermediate lens (and their corresponding finite light source) results in different beam spreads emitting from the lamp due, in part, to the properties of the differing optics on the distal lens. In accordance with some embodiments, the distal lens and the intermediate lens can form a lens element, where the positioning between the lens element and the finite light source can be adjusted to illuminate various combinations of optic element lens and TIR lenses to achieve different beam spread patterns.

Figure 1:
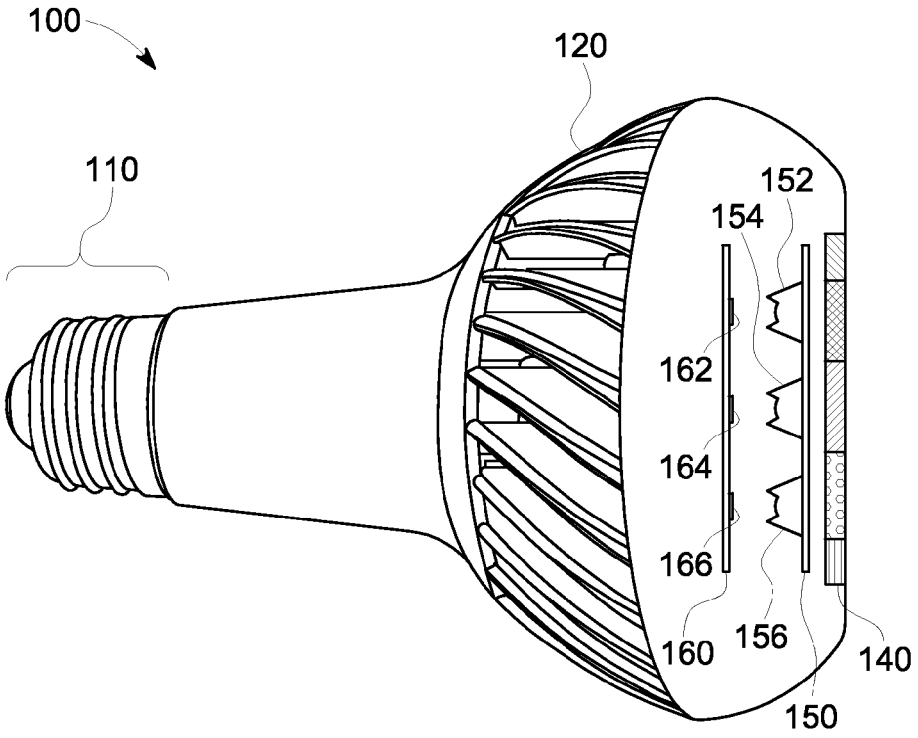
FIG. 1 depicts a cutaway view of a lamp in accordance with some embodiments.

FIG. 1 depicts a cutaway view of lamp 100 in accordance with some embodiments. Lamp 100 includes lamp base 110, and heat sink elements 120. Within lamp 100 are located distal lens 140, intermediate lens 150, and finite light source board 160. In one embodiment the finite light sources located on the finite light source board can be LED light sources 162, 164, 166, although other finite light sources can be implemented. In accordance with some embodiments, lamp 100 can include an internal power supply to convert the alternating current line voltage to a direct current voltage for the finite light sources, if needed.

Each of the finite light sources 162, 164, 166 is located at about (i.e., at or near) the focal point for each of the corresponding TIR lenses 152, 154, 156. When a finite source like an LED is placed at the focal point of the TIR lens, the TIR lens cannot perfectly collimate the light, instead produces a beam with certain full width half maximum (FWHM) beam angle. The larger the light source size for a given lens size, the larger will be the FWHM of the resulting beam. Conversely, the larger the TIR lens size for a given light source size, the smaller will be the FWHM of the resulting beam. Addition of distal lens 140 with its optic elements can increase the beam spread. The optic elements on the distal lens can be, for instance, refracting pillow optics or a surface diffuser pattern.

Figures 2A, 2B:
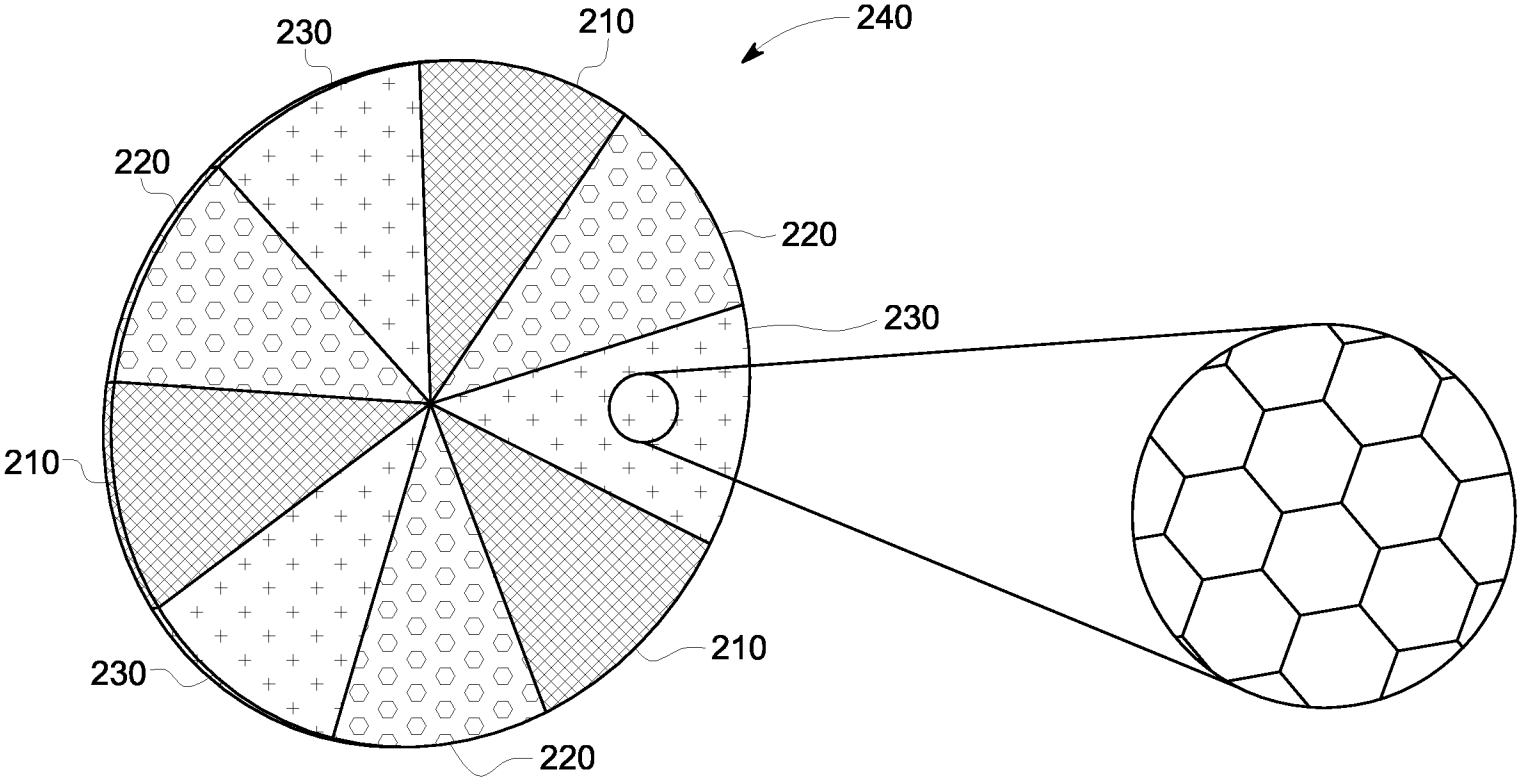
FIG. 2A depicts a distal lens in accordance with some embodiments.
FIG. 2B depicts a surface close up of the distal lens of FIG. 2A.

FIG. 2A depicts distal lens 240 in accordance with some embodiments. Distal lens 240 can be divided into segments (e.g., nine segments), where segments positioned at the same periodicity on the distal lens (e.g., every third segment) has optic elements 210, 220, 230 with the same properties. Thus, neighboring segments are different with the pattern repeating along the distal lens. In FIG. 2A, like segments having optic elements with the same properties are shown with the same cross-hatching. Because the depicted embodiment of the distal lens is circular, the segments are about triangular in shape having an apex at the center of the circle and an arcuate-shaped base opposite the apex. FIG. 2B is a close up of a surface of distal lens 240 showing representative optic elements.

Figure 3A:
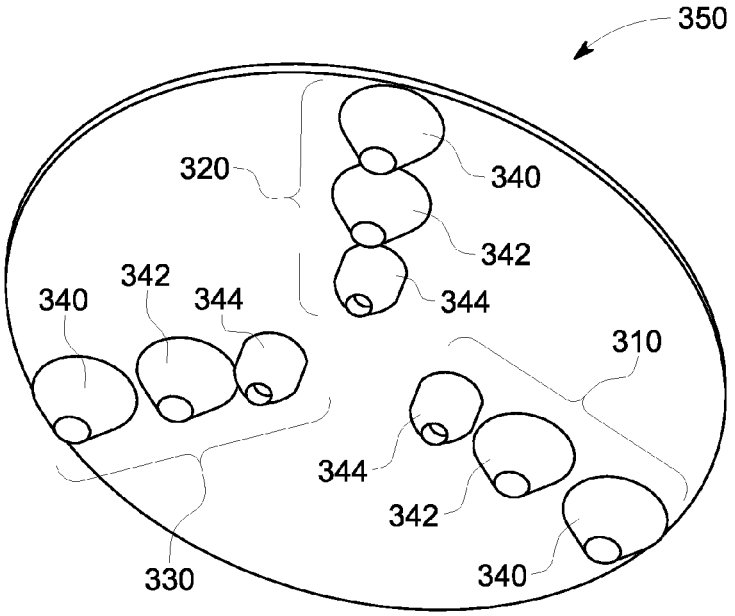
FIG. 3A depicts an intermediate lens in accordance with some embodiments.

FIG. 3A depicts an embodiment of intermediate lens 350 in accordance with some embodiments. Intermediate lens 350 has TIR lens sets 310, 320, 330 positioned equidistant on a surface of intermediate lens (e.g., corresponding to the first, fourth and seventh segments on distal lens 240). In accordance with an embodiment, lens sets 310, 320, 330 extend radially from about the center of a circle. Each lens set includes TIR lenses 340, 342, 344. In accordance with an embodiment, the size of the TIR lens can decrease as its radial position gets closer towards the circle's center. The reduction of the TIR lens size can limit the TIR lens output beam within the particular segment of the distal lens positioned and/or aligned opposite the TIR lens. In accordance with some embodiments, more than one row of lens sets can be disposed on the intermediate lens to correspond with an individual segment of the distal lens.

Figure 3B:
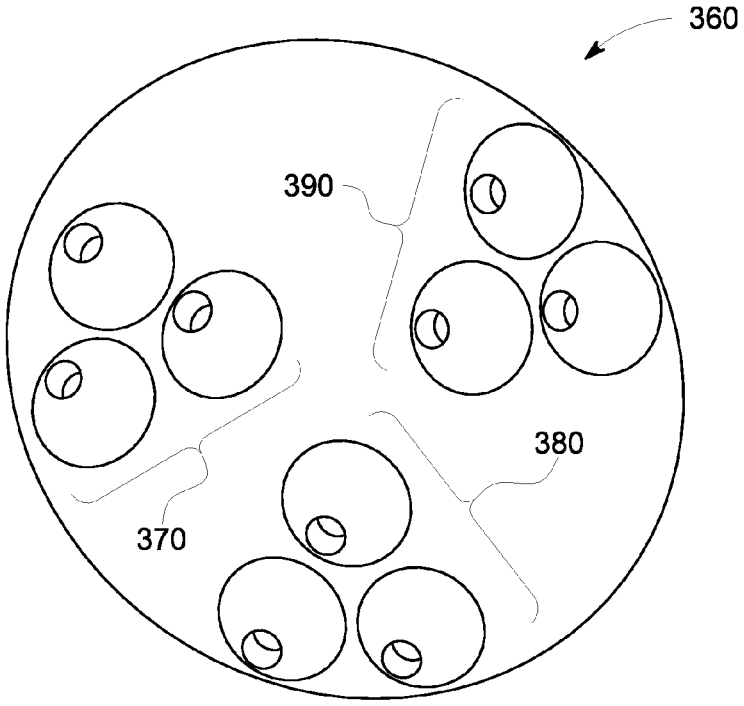
FIG. 3B depicts an intermediate lens in accordance with other embodiments.

In accordance with some embodiments, the TIR lens sets can have other arrangements to correspond with the segment geography of the optical elements on the distal lens. By way of example, FIG. 3B depicts intermediate lens 360 in accordance with some embodiments. Intermediate lens 360 includes TIR sets 370, 380, 390 where the TIR lenses with the lens sets are arranged in a triangular formation to maximize the coverage of the corresponding optical elements. The TIR lenses can be of the same size, or can decrease as their radial position gets closer towards the circle's center.

Figure 4:
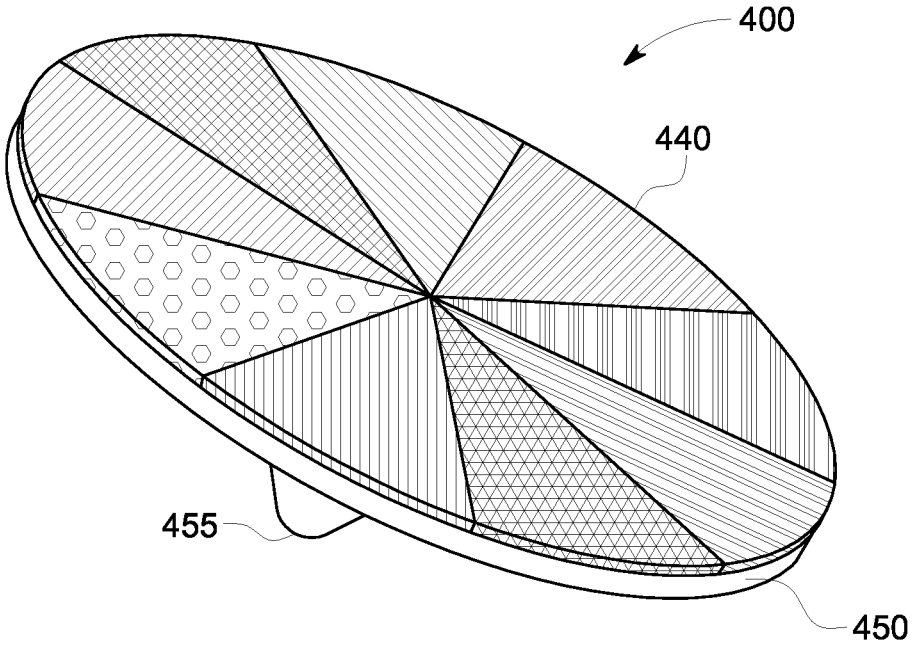
FIG. 4 depicts a lens assembly in accordance with some embodiments.

FIG. 4 depicts lens assembly 400 in accordance with an embodiment. Lens assembly 400 can include distal lens 440 and intermediate lens 450 mounted coaxially. Rotation of the distal lens about a longitudinal axis of the PAR-type lamp results in alignment of similar segments of the distal lens (i.e., those with the same optic elements 210, 220, 230) with the TIR lens sets 310, 320, 330 on the intermediate lens. Lens assembly 400 can include finite light source board 160 with finite light sources positioned at about the focal point of each of TIR lens 340, 342, 344.

In accordance with an embodiment, lens assembly 400 can include a distal lens with a plurality of optical segments, where each of the optical segments has different optical properties from the other optical segments on the distal lens. In this embodiment, the intermediate lens can include just one TIR lens set 455 to illuminate a selected one of the distal lens optical segments at a time.

In accordance with an embodiment, a rotation mechanism can rotate the distal lens by rotating a shaft secured to the center of the distal lens. In accordance with another embodiment, the rotation mechanism can rotate the distal lens by a friction wheel in contact with a circumferential edge, or a surface close to the circumferential edge, of the distal lens.

Figure 5:
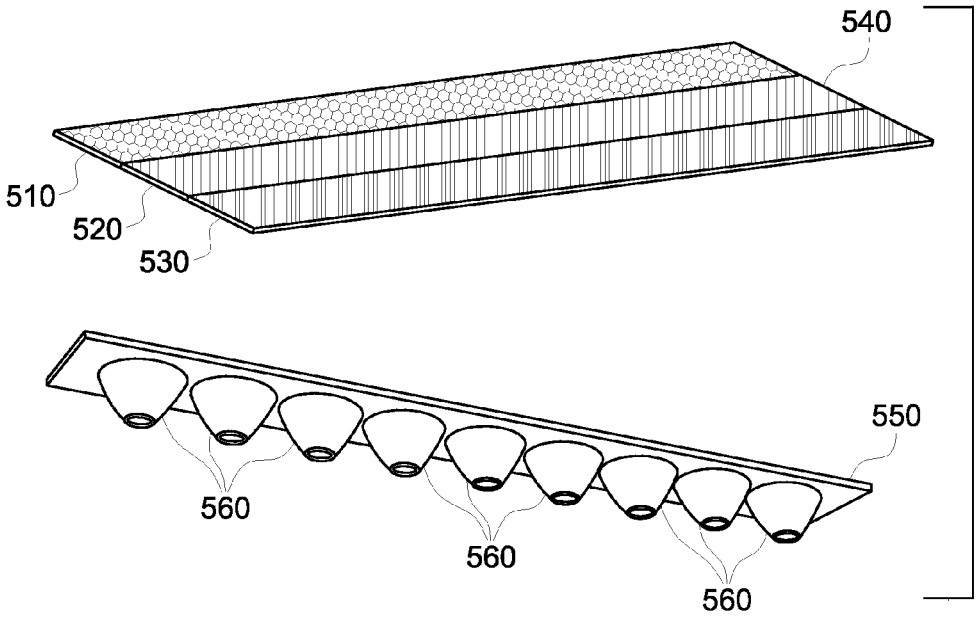
FIG. 5 depicts a distal lens and an intermediate lens in accordance with some embodiments.

FIG. 5 depicts distal lens 540 and intermediate lens 550 in accordance with another embodiment. In accordance with this embodiment, the distal lens is rectangular in shape. Distal lens 540 can include optic segments 510, 520, 530 which each include optic elements that differ between the segments. Intermediate lens 550 can include TIR lens elements 560. TIR lens 560 can each be the same size, and have a finite light source located at about each of their respective focal points. The beam spread can be varied by repositioning the distal lens parallel to the intermediate lens so that a different optical segment 510, 520, 530 is illuminated by the TIR lens elements on intermediate lens 550.

In another embodiment, multiple rows of TIR lenses 560 can be positioned on intermediate lens 550 with a spacing equivalent to the periodicity of repetition of repeating optic segments on distal lens 540.

Figure 6A:
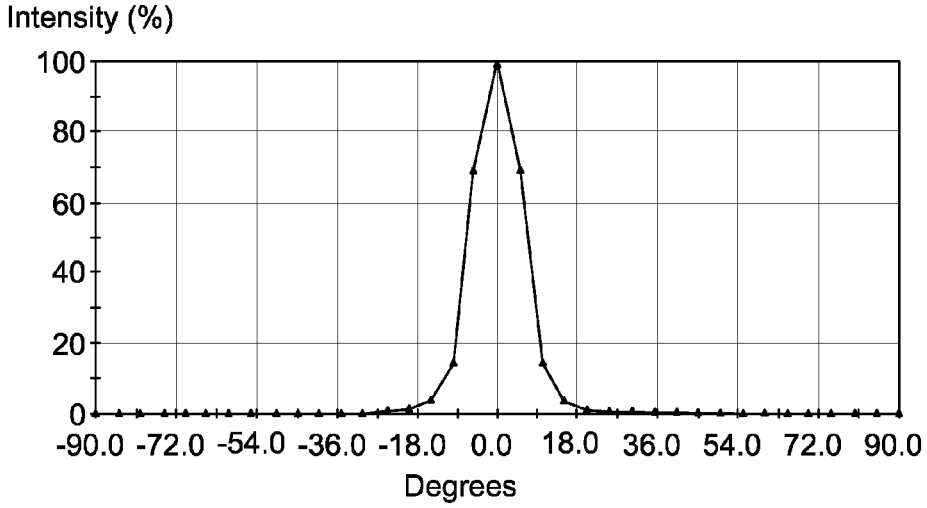
FIGS. 6A-6C depict variable spread beam patterns in accordance with some embodiments.
Figure 6B:
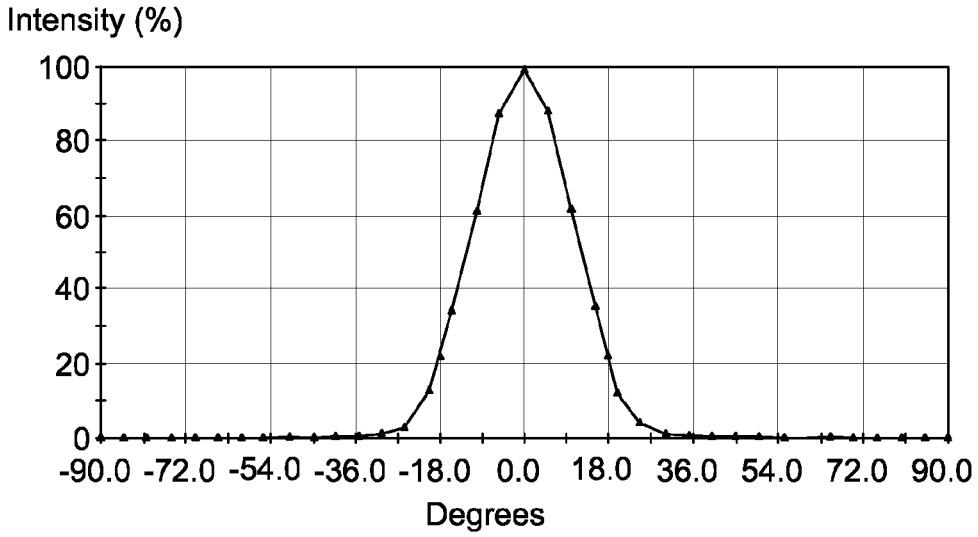
Figure 6C:
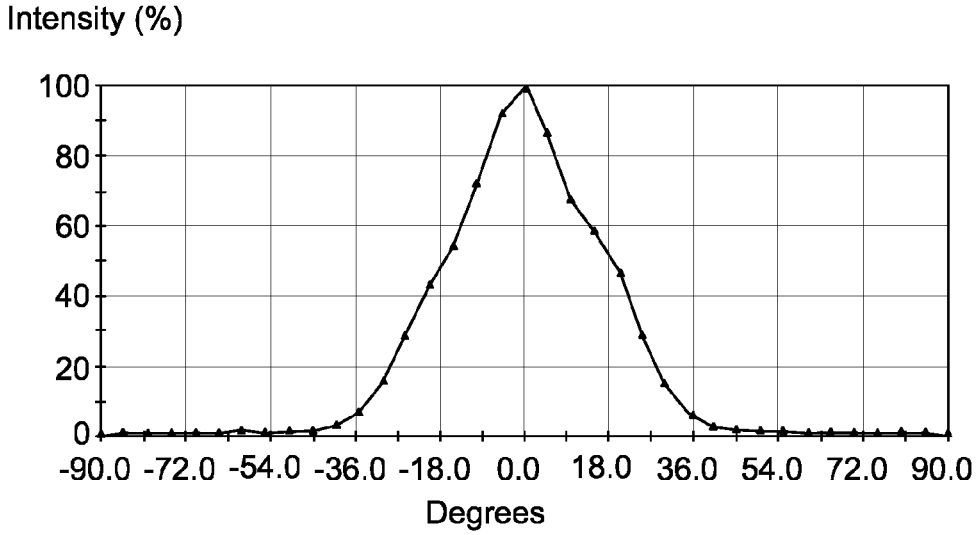

FIGS. 6A-6C depict variable spread beam patterns that can be formed by a variable spread PAR-type lamp in accordance with some embodiments. FIG. 6A depicts a beam spread with a 13° FWHM that is formed with a first optic element segment positioned over the TIR lens elements on the intermediate lens. Repositioning the distal lens so that a second optic element segment having different optical properties can form a broader beam with a 25° FWHM (FIG. 6B). Further still, a third optic element segment on the distal lens with different optical properties can form yet a broader beam with a 40° FWHM (FIG. 6C). Embodiments are not limited to the FWHM beam spreads described above. Rather, the FWHM beam spread is determined by the selection of the optical arrangement (e.g., the optical elements on the distal lens and the TIR lenses on the intermediate lens).

Figure 7:
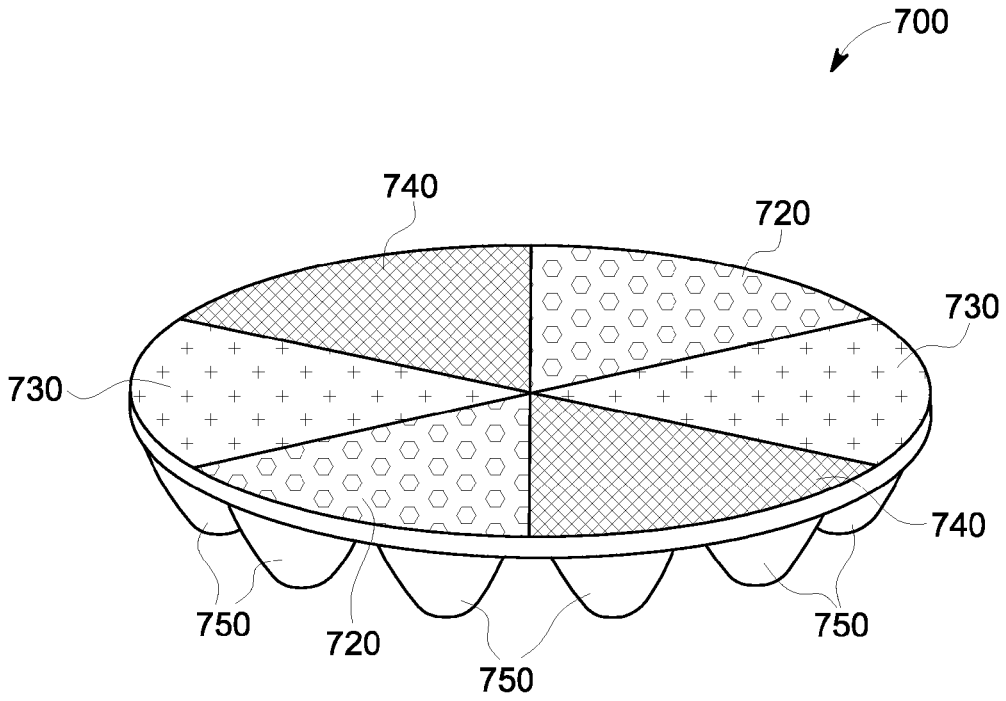
FIG. 7 depicts a lens element in accordance with some embodiments.

FIG. 7 depicts lens element 700 in accordance with some embodiments. Lens element 700 includes, in combination, optical segments 720, 730, 740 and TIR lens elements 750 contained in a single lens element. Finite light sources can be positioned at about the focal points of the TIR lens elements corresponding to one, or a set of similar, optical segments. The lens element can be repositioned (e.g., rotated or slid) with respect to the finite light sources to obtain differing beam spreads according to the properties of the combination of the then illuminated TIR lens elements and optical segment(s).

Although specific hardware and methods have been described herein, note that any number of other configurations may be provided in accordance with embodiments of the invention. Thus, while there have been shown, described, and pointed out fundamental novel features of the invention, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

The invention claimed is:

1. A lamp comprising:

a lamp base and a longitudinal axis;

a first lens located distal from the lamp base, the first lens including a plurality of segments having optic elements, wherein each of the optic elements within a segment have similar optical properties; at least two of the segments having optic elements with different optical properties; wherein said first lens is a circular shaped first lens with triangular shaped segments having an apex at a center of the circular shape;

a second lens located intermediate between the distal lens and the lamp base, the second lens including a plurality of total internal reflection (TIR) lens elements each having a focal point, the second lens including at least one set of TIR lens elements positioned along a radius of the circular shape; and a plurality of finite light sources, each of the plurality of finite light sources located at about a respective one of the TIR lens element focal points.

2. The lamp of claim 1, wherein at least one of the first lens and the second lens is moveable about the longitudinal axis so as to change an alignment between the optic element segments and the TIR lens elements.

3. The lamp of claim 1, wherein a size of each TIR lens element within the at least one set of TIR lens elements decreases along the radius from a circumference of the first lens inwards to the center.

4. The lamp of claim 1, including a finite light source board having mounted thereon the finite light sources.

5. The lamp of claim 1, wherein the finite light sources are light emitting diodes.

6. The lamp of claim 1, including a single lens element containing in combination the first lens and the second lens, the single lens element repositionable about a longitudinal axis of the lamp by at least one of rotating and sliding to change a position of the single lens element with respect to the finite light sources.

7. A lamp comprising:

a lamp base and a longitudinal axis;

a single lens element containing in combination a first lens and a second lens;

the first lens located on a first surface of the single lens element distal from the lamp base, the first lens including a plurality of segments having optic elements, wherein each of the optic elements within a segment have similar optical properties, at least two of the segments having optic elements with different optical properties;

the second lens located on a second surface of the single lens element intermediate between the first lens and the lamp base, the second lens including a plurality of total internal reflection (TIR) lens elements each having a focal point;

a plurality of finite light sources, each of the plurality of finite light sources located at about a respective one of the TIR lens element focal points; and the single lens element repositionable about a longitudinal axis of the lamp by at least one of rotating and sliding to change a position of the single lens element with respect to the finite light sources.

* * * * *